US007049904B2

(12) United States Patent
Shin

(10) Patent No.: US 7,049,904 B2
(45) Date of Patent: May 23, 2006

(54) SEESAW-TYPE MEMS SWITCH AND METHOD FOR MANUFACTURING THE SAME

(75) Inventor: Hyung-jae Shin, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/859,618

(22) Filed: Jun. 3, 2004

(65) Prior Publication Data

US 2005/0012562 A1 Jan. 20, 2005

(30) Foreign Application Priority Data

Jun. 10, 2003 (KR) ..... 10-2003-0037285

(51) Int. Cl.
*H01P 1/10* (2006.01)

(52) U.S. Cl. ..... 333/105; 333/262

(58) Field of Classification Search ..... 333/105, 333/262; 200/181

See application file for complete search history.

(56) References Cited

U.S. PATENT DOCUMENTS 5,578,976 A 11/1996 Yao
5,619,061 A * 4/1997 Goldsmith et al. ..... 257/528
6,307,169 B1 * 10/2001 Sun et al. ..... 200/181
6,714,105 B1 * 3/2004 Eliacin et al. ..... 200/181
6,734,770 B1 * 5/2004 Aigner et al. ..... 335/78
2002/0140533 A1 10/2002 Miyazaki et al.

FOREIGN PATENT DOCUMENTS

EP 1486999 A2 * 12/2004
JP 2001-076605 3/2001
KR 10-2004-0103054 12/2004

* cited by examiner

*Primary Examiner*—Dean Takaoka
(74) *Attorney, Agent, or Firm*—Lee & Morse, P.C.

(57) ABSTRACT

In a seesaw-type MEMS switch for radio frequency (RF) and a method for manufacturing the same, the seesaw-type MEMS switch for radio frequency (RF) includes a substrate, a transmission line formed on the substrate having a gap therein to provide a circuit open condition, an intermittent part formed a predetermined distance from the substrate, the intermittent part being operable to contact the transmission line on both sides of the gap by performing a seesaw movement about a seesaw movement axis, and a driving part to drive the seesaw movement of the intermittent part in response to a driving signal.

25 Claims, 7 Drawing Sheets

SEESAW-TYPE MEMS SWITCH AND METHOD FOR MANUFACTURING THE SAME

BACKGROUND OF THE INVENTION

1. Field of the Invention

The present invention generally relates to a MEMS (Micro Electro Mechanical System) for RF (Radio Frequency). More particularly, the present invention relates to a MEMS switch for RF that can be driven at a low voltage and a method for manufacturing the same.

2. Description of the Related Art

Generally, MEMS is a micro electro mechanical system that is manufactured using a semiconductor process. Recently, MEMS has been the focus of increased attention as a range of applications of MEMS technology has increased in connection with the development of mobile communication technology. Among such MEMS applications, a gyroscope, an acceleration sensor, an RF switch, and the like are being applied to products. In addition, the development of various other MEMS products has accelerated.

A MEMS RF switch is embodied to switch a signal when a micro-sized MEMS structure on a semiconductor substrate moves to contact a signal electrode or to intercept a signal transmission when the MEMS structure is separated from the signal electrode. This MEMS switch has advantages in that it exhibits a lower insertion loss upon being switched "ON" and a higher attenuation coefficient upon being switched "OFF," as compared to conventional semiconductor switches. Further, it requires a significantly lower switch driving power than conventional semiconductor switches. In addition, it has gained public attention as a device suitable for RF communication since an application frequency range thereof extends up to about 70 GHz.

However, this MEMS switch for RF also has a problem in that it requires a high driving voltage since it uses an electrostatic force and a stiction, i.e., static friction, phenomenon may occur at a contact point. The stiction phenomenon describes an unintended and undesirable adhesion that occurs on a surface of a microstructure when a restitution force does not overcome interfacial forces, such as a capillary force, a van der Waals force, an electrostatic attraction, and the like, thus causing the contact point to become stuck, either permanently or for an unwanted period of time. The stiction phenomenon may be generally classified into two types, a sacrificial layer release-related stiction and an in-use stiction. The first type, the sacrificial layer release-related stiction, is an adhesion referring to a circumstance, in which a structure sticks at a bottom and is not released therefrom because of a liquid capillary force during an intended release of the structure. This phenomenon may be solved by technologies to avoid a liquid-vapor interface, such as sublimation release, supercritical drying, HF vapor release, and the like. In addition, there is a method to reduce the capillary force by forming a small protrusion around the microstructure to change a liquid meniscus.

However, these methods cannot additionally avoid occurrence of the second type, the in-use stiction, in which a microstructure is not restored due to humidity or an excessive impact generated while in use. This occurs because when surfaces of adjacent microstructures contact each other, a capillary force, an electrostatic attraction, a van der Waals force, or the like, are also generated and surface adhesion may occur due to these forces, whereby stiction of the structure takes place, causing damage to a device. In an attempt to solve the in-use stiction, a method to reduce a surface contact area by forming a micro dimple and a method to manufacture a polycrystalline silicon surface to a microscopic level have been proposed. In addition, methods to modify a surface of a microstructure using chemicals, i.e., chemical modification of the surface, have been proposed. The proposed chemical modification methods include use of hydrogen passivation, hydrogen-bonded fluorinated monolayers, plasma-deposited fluorocarbon thin films, covalently-bound hydrocarbon self-assembled monolayer (SAM), and others. Among these, a representative method is the self-assembled monolayer (SAM) method. The SAM method is a technology to prevent the stiction phenomenon by subjecting a silicon wafer surface to a chemical. However, the SAM method has several disadvantages, e.g., requiring complex treatment procedures, a significant cost of production, and a high dependency on temperature.

As described above, with respect to a MEMS switch for RF, research has been conducted on all aspects of the device to solve problems related to stiction, however, there is still a demand for a more economical and effective embodiment to be applied in industrial products. Therefore, attempts have been made to apply MEMS structures and driving methods thereof as a low-cost solution for the stiction phenomenon.

FIGS. 1A and 1B illustrate a plan view and a cross-sectional view taken along line 2–2' of FIG. 1A, respectively, of a conventional MEMS switch for RF. Referring to FIGS. 1A and 1B, the conventional MEMS switch for RF includes a driving electrode 16 formed on a substrate 12, a transmission line 18 having a cut region, a cantilever beam support pillar 14, a cantilever beam 20 formed a particular distance from the substrate, i.e., a predetermined height above the substrate, by means of the cantilever beam support pillar 14, an upper electrode 24 formed on the cantilever beam having a region facing a lower electrode 16, and a contact part 22 formed on a lower surface at an opposite end from the cantilever beam support pillar 14 of the cantilever beam 20 to face the cut region of the signal transmission line 18 to electrically connect the transmission line 18. Here, both the cantilever beam 20 and the upper electrode 24 have a spring part 23 connecting a region 26 facing the lower electrode 16 and an upper region of the support pillar 14 so that the cantilever beam can resiliently move upward and downward, as shown by arrow 11 in FIG. 1B. The spring part 23 connects the lower electrode facing region 26 and the upper region of the support pillar in a form of a narrow linear band.

In the above-described conventional MEMS switch for RF, a moving side of the cantilever beam 20, i.e., the side opposite from the side attached to the cantilever beam support pillar 14, can move downward by an electrostatic force generated due to a potential difference applied to the upper and lower electrodes 24 and 16 and this downward movement of the cantilever beam 20 allows the contact part 22 to electrically connect the cut region of the transmission line 18. Thus, a signal can pass along the transmission line 18. Alternatively, when the driving voltage applied to the upper electrode 24 and the lower electrode 16 is removed for signal interception, the contact part 22 is separated from the transmission line by a resilient resititution force of the cantilever beam 20 and returns to an original state. At this time, the spring part 23 helps the contact part to be separated more resiliently from the transmission line. That is, in an effort to solve problems related to stiction, the spring part is used to further increase the restitution force of the cantilever beam, as compared to a conventional cantilever beam without a spring part.

However, this conventional MEMS switch for RF has a problem in that the driving voltage necessary to move the cantilever beam 20 is increased. More specifically, the driving force F needed to move the cantilever beam 20 satisfies a relation directly proportional to the area A of the electrode but inversely proportional to the square of the distance d between the lower electrode 16 and the upper electrode 24 on the cantilever beam. However, when the spring stiffness of the cantilever beam 20 is raised to increase the restitution force needed to separate the contact part connected to the transmission line 18, additional driving force is needed to move the cantilever beam 20. In order to increase the driving force, the area of the electrode should be expanded or the driving voltage should be increased. Since an expansion of the area of the electrode may cause negative effects, such as an increase of adhesion, the driving voltage is raised to increase driving power. For this reason, conventional MEMS-type switches have a driving voltage exceeding 10 V. Consequently, such a high driving voltage of a MEMS switch for RF requires a separate circuit for increasing the voltage, which contributes to an increase in cost, since general portable terminals are normally driven at a voltage as low as 3 V.

In addition, the MEMS switches for RF having a bridge-type or a cantilever-type (cantilever beam-type) structure totally depend on stiffness of the structure when restituting the contact point. However, in a case like a switch, the time when the state conversion occurs is not regular and a duration of a state may be relatively long. Accordingly, when a state lasts for a relatively long period of time, creep (or memory effect) may occur, which inhibits restitution to the other state. That is, in a case of a bridge-type or cantilever-type MEMS switch for RF, since a state changing part always receives one type of stress, such as N-T-N (Neutral-Tension-Neutral) or N-C-N (Neutral-Compressive-Neutral), except during the initial state, it cannot be restituted to the original state when used for a long period of time, which causes deterioration in RF properties.

SUMMARY OF THE INVENTION

Accordingly, in an effort to solve the above-described problems, it is a feature of an embodiment of the present invention to provide a seesaw-type MEMS switch for RF that can be driven by a low driving voltage and prevent deterioration in RF properties.

To provide the above feature of the present invention, an embodiment of the present invention provides a seesaw-type MEMS switch for radio frequency (RF) includes a substrate, a transmission line formed on the substrate having a gap therein to provide a circuit open condition, an intermittent part formed a predetermined distance from the substrate, the intermittent part being operable to contact the transmission line on both sides of the gap by performing a seesaw movement about a seesaw movement axis, and a driving part to drive the seesaw movement of the intermittent part in response to a driving signal.

Preferably, the intermittent part includes first spacers formed on a common electrode on the substrate, a first pivot part connected between the first spacers, and an intermittent bar cross-connected to the first pivot part for performing the seesaw movement. Preferably, the intermittent bar includes a contact part adapted to electrically contact the transmission line on both sides of the gap and a support cross-connected with the first pivot part to support the contact part. Preferably, the support is formed of an insulating material and the contact part is formed at a bottom of the support to have a surface facing the gap. Preferably, the contact part is formed in a T-shape for providing surface-to-surface contact with the transmission line on both sides of the gap. Also preferably, the contact part includes a spring part formed by removing a portion of the contact part in contact with the support.

The transmission line may include first and second transmission lines diverging from a signal input terminal, each having a gap at a position corresponding to an end of the intermittent bar.

Preferably, the driving part includes second spacers, each being formed to either side of the intermittent bar on the common electrode on the substrate, lower electrodes, each formed at either side of the seesaw movement axis of the intermittent bar and on either side of the common electrode, respectively, over the substrate, upper electrodes connected to the common electrode by the second spacers and second pivot parts, the upper electrodes being formed at either side of the intermittent bar to have a surface facing the lower electrodes, and a seesaw descent part connected to the upper electrodes to push down a side of the intermittent bar along with the seesaw movement of the upper electrodes descending in response to the driving signal selectively applied to one of the lower electrodes so that a contact part of the intermittent bar contacts the transmission line on both sides of the gap. The seesaw descent part may include third spacers formed on the upper electrodes at either side of the intermittent bar and cross bars connecting adjacent third spacers at either side of the intermittent bar on the upper electrodes. The cross bars may be formed to have a block C-shape.

The intermittent part may include a contact part for providing surface-to-surface contact with the transmission line on both sides of the gap in response to the driving signal and a spring part, integral with the contact part, for deforming in response to the driving signal. Dimensions of the spring part may be determined in accordance with a desired resilience.

A length of the intermittent bar may be determined in accordance with a magnitude of the driving signal.

The seesaw-type MEMS switch for RF may further include a first electrode below the intermittent part and a second electrode above the intermittent part, the first and second electrodes being separate form the intermittent part and it may even further include a limiting element restricting movement of the second electrode away from the first electrode.

To provide another feature of the present invention, an embodiment of the present invention provides a seesaw-type MEA method for manufacturing a MEMS switch for radio frequency (RF) including providing a first insulating layer on a substrate, forming a transmission line, a common electrode, and lower electrodes on the first insulating layer, the transmission line having a gap therein for providing a circuit open condition and the lower electrodes being formed at either side of the common electrode to receive a driving signal, forming first and second spacers on the common electrode, forming an intermittent bar crossing a first pivot part connected between the first spacers, the intermittent bar being operable to electrically connect both sides of the gap formed in the transmission line, and forming upper electrodes at either side of the intermittent bar, the upper electrodes being connected to the second spacers by a second pivot part pivoting coaxially with the first pivot part and crossing the lower electrodes formed at either side of the common electrode, and forming a seesaw descent part to push down the intermittent bar due to the descending movement of one side of the upper electrodes descending in response to the driving signal selectively applied to one of the lower electrodes at either side of the common electrode so that one side of the intermittent bar contacts the transmission line on both sides of the gap.

Forming the transmission line may include forming a first transmission line and a second transmission line diverging from a signal input terminal and providing a gap in each of the first and second transmission lines at a position corresponding to an end of the intermittent bar.

Forming the first and second spacers may include providing a sacrificial layer over the substrate having the transmission line, the common electrode, and the lower electrodes formed thereon, forming via holes for first and second spacers to communicate with the common electrode through the sacrificial layer, and providing a metal layer on the sacrificial layer with the via holes formed therethrough.

Forming the intermittent bar may include forming a contact portion that contacts the transmission line on both sides of the gap and a spring portion that deforms in response to the driving signal. Forming the spring portion may include determining dimensions of the spring portion to provide a desired resilience of the spring portion. Forming the intermittent bar may also include determining a length of the intermittent bar in accordance with the driving signal.

The MEMS switch for RF having the above-described construction, in which the intermittent part and the driving part are separated from each other so that interaction between the respective electrodes and the contact point may be controlled, can control stiction by means of the areas of the electrodes and minimize the driving voltage since it can be restituted simultaneously with the removal of the driving voltage applied to the lower electrode. Further, by using the seesaw movement, it is possible to prevent deformation of the structure when used for an extended period of time.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF THE INVENTION

Figure 1A:
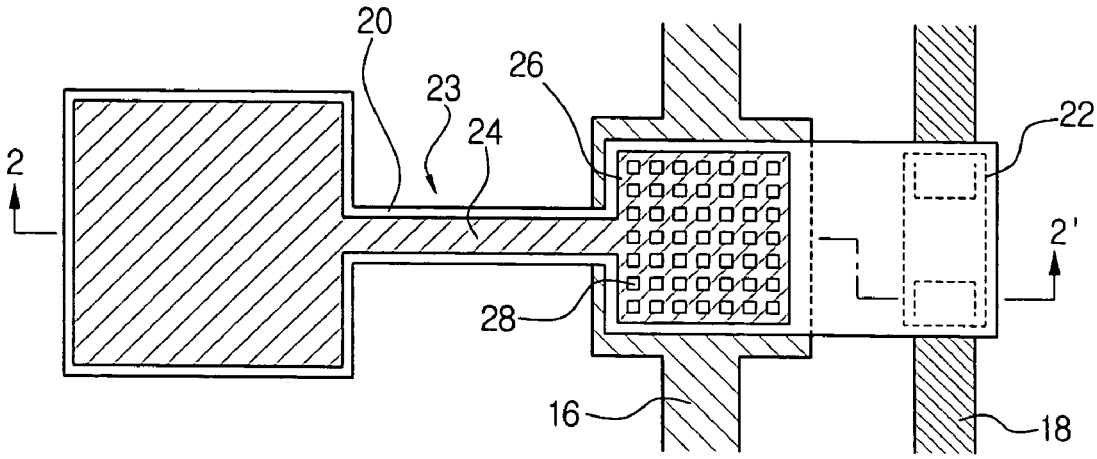
FIG. 1A (PRIOR ART)
FIGS. 1A and 1B illustrate a plan view and a cross-sectional view taken along line 2—2 of FIG. 1A, respectively, of a conventional MEMS switch for RF.
Figure 1B:
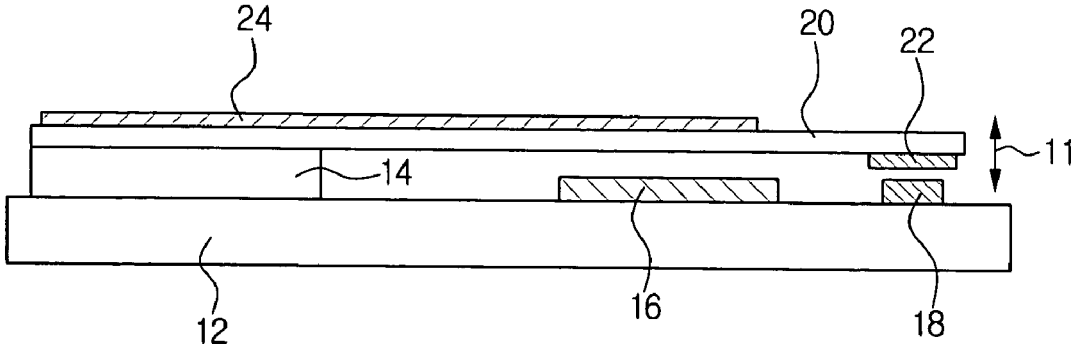
FIG. 1B (PRIOR ART)

Korean Application No. 2003-37285, filed Jun. 10, 2003, and entitled: "Seesaw-type MEMS Switch for Radio Frequency and Method for Manufacturing the Same," is incorporated by reference herein in its entirety.

The present invention will now be described more fully hereinafter with reference to the accompanying drawings, in which preferred embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. It will also be understood that when a layer is referred to as being "on" another layer or substrate, it can be directly on the other layer or substrate, or intervening layers may also be present. In addition, it will be understood that when a layer is referred to as being "between" two layers, it can be the only layer between the two layers, or one or more intervening layers may also be present. In the figures, the dimensions of layers and regions are exaggerated for clarity of illustration. Like reference numerals refer to like elements throughout. Moreover, a plurality of like elements may be expressed by a single representative reference numeral and described using plural or collective singular terms.

Figure 2:
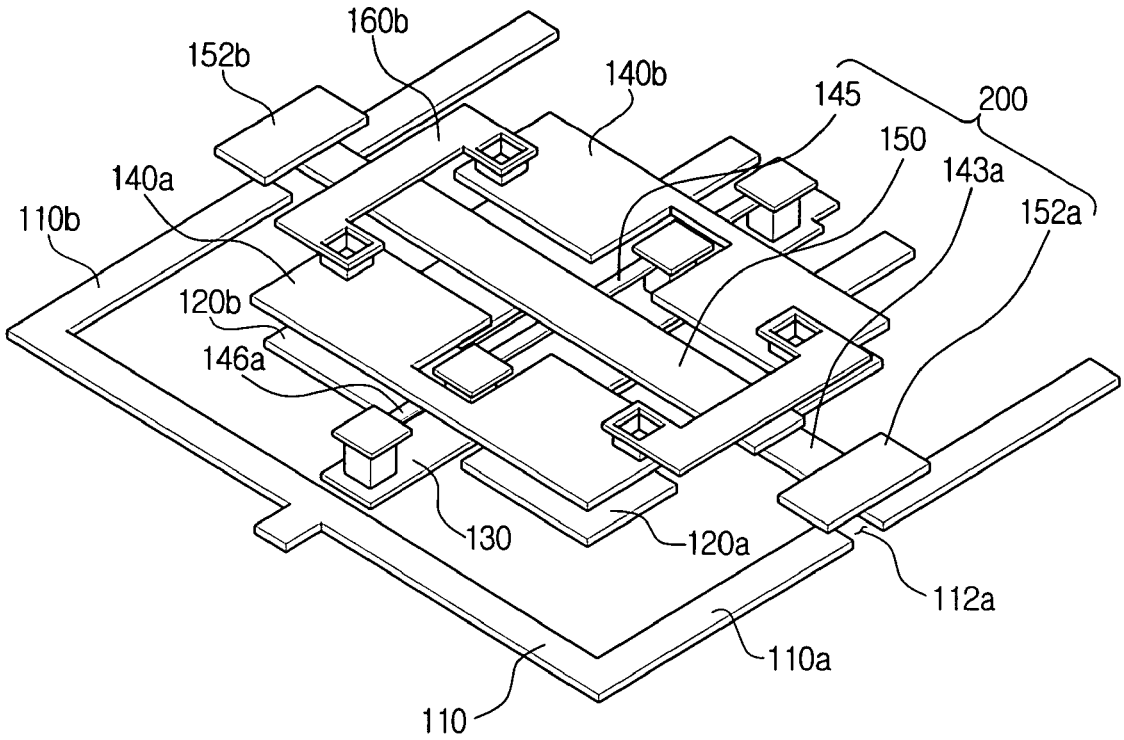
FIGS. 2 and 3 illustrate a perspective view and an exploded view, respectively, of a seesaw-type MEMS switch for RF according to an embodiment of the present invention.
Figure 3:
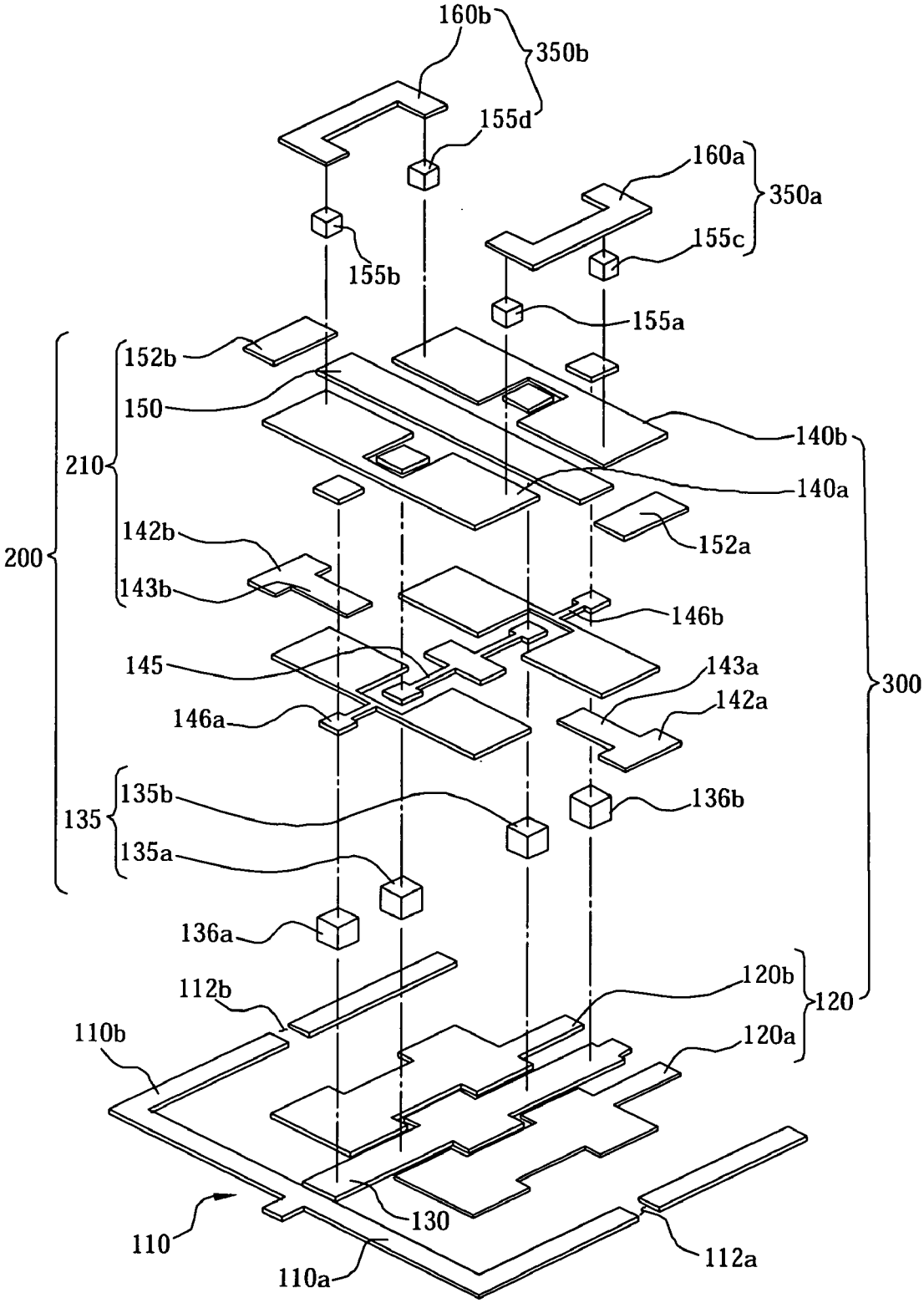

FIGS. 2 and 3 illustrate a perspective view and an exploded view, respectively, of a seesaw-type MEMS switch for RF according to an embodiment of the present invention. The MEMS switch for RF includes a transmission line 110 having gaps 112*a*, 112*b* over a semiconductor substrate, an intermittent part 200, which is able to perform a seesaw movement, disposed a predetermined distance from the substrate, i.e., a predetermined height above the substrate, and a driving part 300 to drive the seesaw movement of the intermittent part 200.

The transmission line 110 diverges from a signal input terminal into first and second transmission lines 110*a*, 110*b* having gaps 112*a*, 112*b*, respectively. The gaps 112*a*, 112*b* provide a circuit open condition. The gaps 112*a*, 112*b* are formed on opposite sides of the transmission line 110.

The intermittent part 200 includes first spacers 135*a*, 135*b* formed on a common electrode 130, a first pivot part 145 connected between the first spacers 135*a*, 135*b* and an intermittent bar 210 cross-connected to the first pivot part 145. The intermittent bar 210 is able to perform the seesaw movement by rotating about a pivot (or seesaw movement) axis that extends longitudinally through the first pivot part 145 and a pair of second pivot parts 146*a*, 146*b*. More specifically, the second pivot parts 146*a*, 146*b* and the first pivot part 145 pivot coaxially about the pivot (or seesaw movement) axis. Here, the intermittent bar 210 has a first contact part 142*a* and a second contact part 142*b*, which are made of a metallic thin layer, each one formed at an end of the intermittent bar 210 to electrically contact both sides of a corresponding one of the gaps 112*a*, 112*b*, i.e., bridge the gaps, of the first and second transmission lines 110*a*, 110*b*, respectively, and a support 150, which is made of an insulating material, cross-connected to the first pivot part 145 in one body to support from above the first and second contact parts 142*a*, 142*b*. The first and second contact parts 142*a*, 142*b* are connected to the support 150 by first and connectors 152*a*, 152*b*, respectively. Each of the first and second contact parts 142*a*, 142*b* have a T-shape to provide surface-to-surface contact with both sides of a corresponding one of the gaps 112*a*, 112*b* in the transmission line 110.

In addition, the first and second contact parts 142*a*, 142*b* are each provided with a spring part 143*a*, 143*b*, respectively, formed by removing a portion of contact part 142*a*, 142*b* that is in contact with, i.e., bound to, the support 150.

The driving part 300 includes second spacers 136*a*, 136*b*, each one being formed beyond an end of the first pivot part 145 on the common electrode 130, first and second lower electrodes 120*a*, 120*b* formed at either side of the common electrode 130 on the substrate, first and second upper electrodes 140*a*, 140*b* connected to the second spacers 136*a*, 136*b* through the second pivot parts 146*a*, 146*b* and formed at either side of the intermittent bar 210 to have a contact surface crossing the lower electrodes 120*a*, 120*b* disposed at either side of the common electrode 130, and seesaw descent parts 350*a*, 350*b* connected to the upper electrodes 140*a*, 140*b*, to push down an end of the support 150 of the intermittent bar 210 so that one of the contact parts 142*a* or 142*b* at one side of the intermittent bar 210 contacts the transmission line 110 at both sides of one of the corresponding gaps 112*a* or 112*b* as one side of the upper electrodes 140*a*, 140*b* descends. Here, the seesaw descent parts 350*a*, 350*b* have third spacers 155*a*, 155*b*, 155*c*, 155*d* formed at either end of the first and second upper electrodes 140*a*, 140*b* to be opposite to each other centering around the intermittent bar 210. First and second cross bars 160*a*, 160*b* connect adjacent third spacers, i.e., 155*a* to 155*c* and 155*b* to 155*d*.

FIGS. 4A through 4F illustrate cross-sectional views sequentially showing stages in the process for manufacturing the seesaw-type MEMS switch for RF shown in FIG. 2. Here, since the MEMS switch for RF has a symmetrical structure, each view omits one-half of the symmetrical structure. In addition, though a plurality of each particular element in the MEMS switch for RF is generally formed, the following description may include singular references to the elements to facilitate explanation thereof.

Figure 4A:
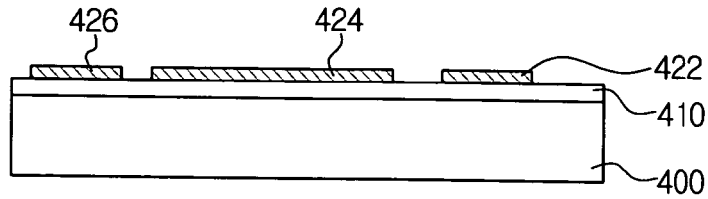
FIGS. 4A through 4F illustrate cross-sectional views sequentially showing stages in a processes for manufacturing the seesaw-type MEMS switch for RF shown in FIG. 2.

As shown in FIG. 4A, the MEMS switch for RF is formed by firstly providing a first insulating layer 410 on a semiconductor substrate 400, providing a metal film on the first insulating layer 410 and forming a signal transmission line 426, a lower electrode 424, and a common electrode 422 by a commonly used patterning process. Here, the commonly used patterning process refers to procedures for forming a structure of a desired shape by masking, exposing to light, developing, and etching in a semiconductor process.

Figure 4B:
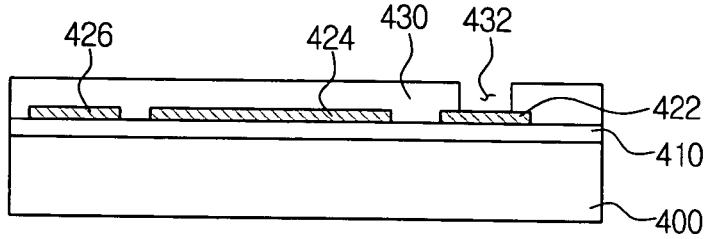

Then, as shown in FIG. 4B, a first sacrificial layer 430 is provided, e.g., by a lamination process, on the insulating layer 410 having the transmission line 426, the lower electrode 424 and the common electrode 422 formed thereon. A first via hole 432 for a spacer is formed through the first sacrificial layer 430 to expose a portion of the common electrode 422.

Figure 4C:
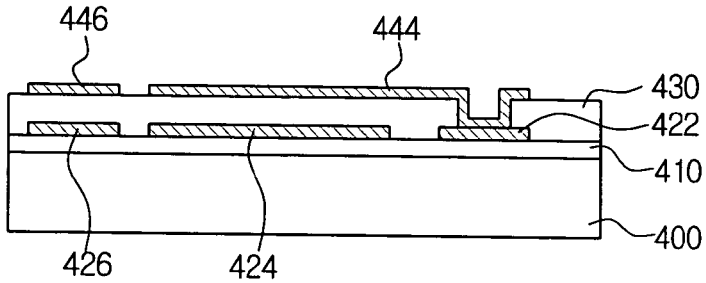

Next, as shown in FIG. 4C, a metal layer is secondarily provided on the first sacrificial layer 430 having the first via hole 432 formed therethrough. The secondarily provided metal layer is subjected to a commonly used patterning process to form a contact part 446 and an upper electrode 444.

Figure 4D:
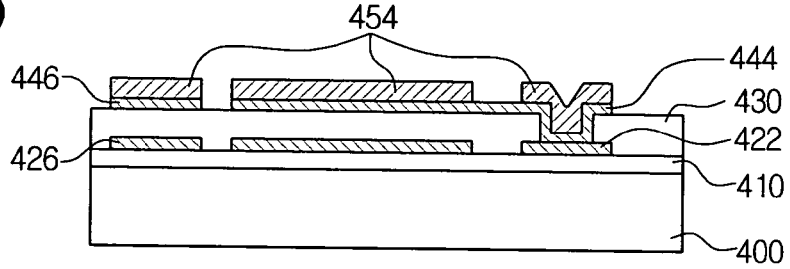

As shown in FIG. 4D, a second insulating layer is provided on the resultant structure and the second insulating layer is subjected to a patterning process to form a support 454. The support 454 supports a contact part 446 and a reinforcement part 454 to reinforce the contact part 446 and the upper electrode 444.

Figure 4E:
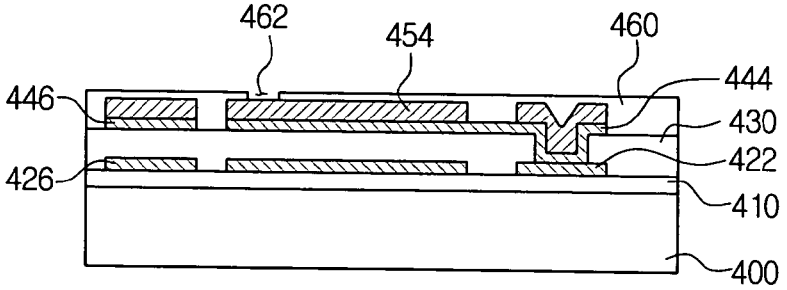

Next, as shown in FIG. 4E, a second sacrificial layer 460 is provided on the resultant structure. A second via hole 462 is formed through the second sacrificial layer 460 to expose a portion of the reinforcement part 454 of the upper electrode 444.

Figure 4F:
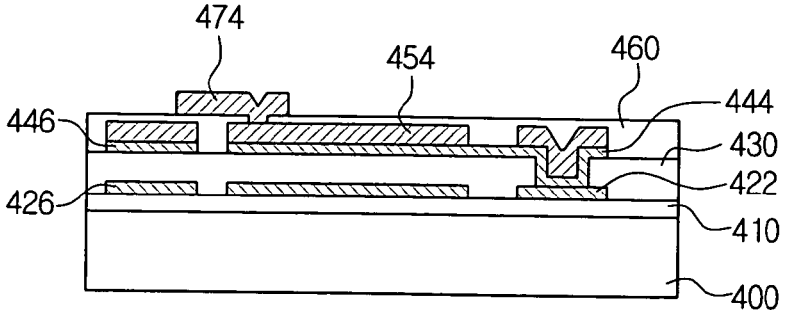

As shown in FIG. 4F, a third insulating layer is provided on the second sacrificial layer 460 having the second via hole 462 formed therethrough. The third insulating layer is subjected to a patterning process to form a cross bar 474. Then, the first and second sacrificial layers 430, 460 are removed.

Referring back to FIGS. 2 and 3, in the MEMS switch for RF having the construction as described above, when an external driving signal is selectively applied to either one of the first or second lower electrodes 120*a*, 120*b*, which are symmetrically formed about the common electrode 130 on the substrate, e.g., a driving signal is applied to the first lower electrode 120*a*, a potential difference occurs between first lower electrode 120*a* and the first and second upper electrodes 140*a*, 140*b* formed a predetermined distance therefrom, crossing the lower electrodes 120*a*, 120*b* at either side of the common electrode 130. Due to this potential difference, an attraction occurs between the first lower electrode 120*a* and a corresponding side of the upper electrodes 140*a*, 140*b* (in the figures it is the right side) and a momentum is generated to rotate the second pivot parts 146*a*, 146*b* connected to the upper electrodes 140*a*, 140*b* in a direction toward the first lower electrode 120*a*. Here, if the rotating momentum generated around the second pivot parts 146*a*, 146*b* is greater than a twisted spring restoring force applied to the second pivot parts 146*a*, 146*b*, one side of the upper structure, which includes the first and second upper electrodes 140*a*, 140*b* and the cross bars 160*a*, 160*b* that corresponds to the first lower electrode 120*a*, is inclined down about the pivot axis that longitudinally extends through the second pivot parts 146*a*, 146*b* and the first pivot part 145. Here, the first cross bar 160*a* at the corresponding (right) side descends to contact the corresponding (right) end of the support 150 and push down that end of the support 150. Then, the T-shaped first contact part 142*a* connected to the support 150 comes into contact with the first transmission line 110*a* at both sides of the gap 112*a* and electrically bridges the gap, so that an RF signal from the signal input terminal can be transmitted to a subsequent signal processing terminal (not shown) through the first transmission line 110*a*.

Figure 5:
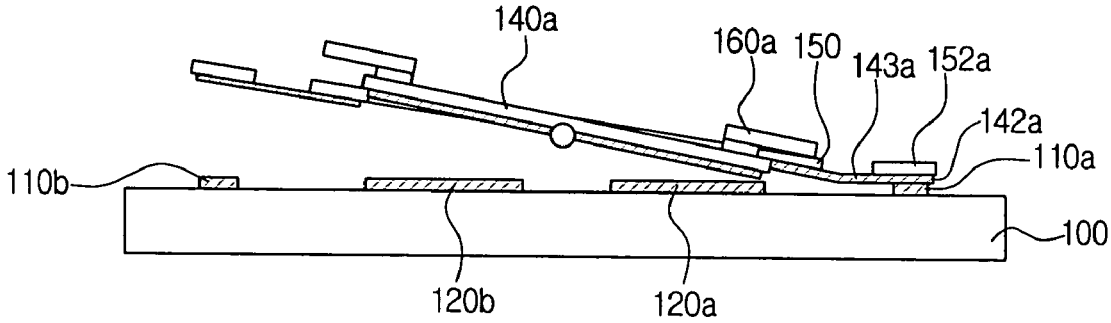
FIG. 5 illustrates a sectional view of the seesaw-type MEMS switch for RF, shown in FIG. 2, in a state of contacting a transmission line.

FIG. 5 illustrates a sectional view of the seesaw-type MEMS switch for RF shown in FIG. 2 in a state of having been driven to one side to transmit a RF signal through one of the first or second transmission lines. In FIG. 5, the moving structure is inclined to the right side about the pivot axis so that the first contact part 142*a* is in contact with the first transmission line 110*a*. Alternatively, if a driving signal is applied to the second lower electrode 120*b*, the upper structure would be inclined to the left side and the second contact part 142*b* would contact the second transmission line 110*b* in a similar manner, so that an RF signal transmitted to the signal input terminal would be transmitted to a subsequent signal processing terminal through the second transmission line 110*b*.

With further reference to FIGS. 2 and 3, in the seesaw-type MEMS switch for RF, the intermittent bar 210 and the upper electrodes 140*a*, 140*b* are separated from each other. Due to this separated double structure, which provides for independent movement between the intermittent bar 210 and the upper electrodes 140*a*, 140*b*, it is possible to make the upper structure immediately return to a horizontal state after removal of the driving signal applied to either one of the lower electrodes 120*a*, 120*b*. For example, when the driving signal applied to the first lower electrode 120*a* in the MEMS switch for RF is removed, the parts of the upper electrodes 140*a*, 140*b* which have been inclined down make a seesaw movement in the opposite direction to return to the horizontal state regardless of contact of the first contact part 142*a* with the first transmission line 110*a*. That is, the movement is automatically made due to the power of the second pivot parts 146*a*, 146*b* and the upper electrodes 140*a*, 140*b* to restore the horizontal state.

Figure 6A:
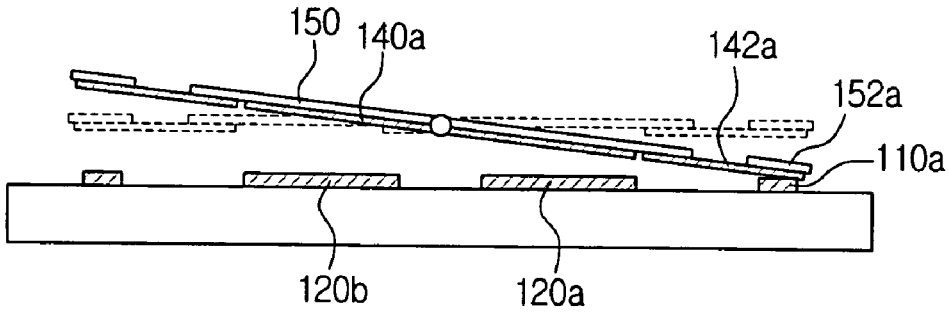
FIGS. 6A and 6B illustrate sectional views for explaining a relationship with driving voltage when upper electrodes and an intermittent part are formed in one body and when upper electrodes and the intermittent part are formed separately, respectively.
Figure 6B:
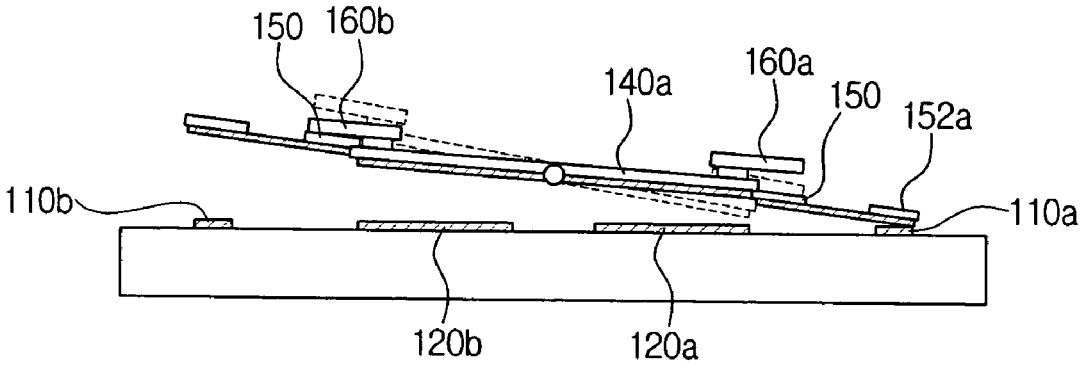

FIG. 6A illustrates an embodiment in which the upper electrodes 140*a*, 140*b* are integral with the intermittent bar 210, viz. the support 150. If the upper electrodes 140*a*, 140*b* are integral with the intermittent bar 210, the cross bars 160*a*, 160*b* are not needed to support the upper electrodes 140*a*, 140*b*. In FIG. 6A, the solid rendition shows the intermittent bar 210 in contact on the right side, while the dashed rendition shows the intermittent bar 210 in a horizontal state FIG. 6B illustrates an embodiment in which the upper electrodes 140*a*, 140*b* are separate from the intermittent bar 210. In FIG. 6B, the solid rendition shows the intermittent bar 210 in contact on the right side, while the dashed rendition shows where the electrodes 140*a*, 140*b* would be positioned absent the limiting force of the cross bars 160*a*, 160*b*, as explained below.

Referring to FIG. 6B, the second cross bar 160*b* comes into contact with an end of the other side opposite to the inclined side of the support 150, as the upper electrodes 140*a*, 140*b* return to the horizontal state. Thus, a distance between one of the lower driving electrodes 120*b* and the upper driving electrodes 140*a*, 140*b* decreases, thereby making it possible to reduce a driving voltage. Thus, the cross bars 160*a*, 160*b* serve as limiting elements restricting movement of the upper electrodes 140*a*, 140*b*.

If the intermittent bar 210 and the upper electrodes 140*a*, 140*b* are formed in a single body in a structure constituting the seesaw-type MEMS switch for RF, i.e., independent movement of the intermittent bar 210 and the upper electrodes 140*a*, 140*b* is prevented, when the upper structure is inclined to one side as shown in FIG. 6A, the distance between the second lower electrode 120*b* and upper electrodes 140*a*, 140*b* at the opposite side becomes larger than in the horizontal state. Thus, in order to switch states, a voltage greater than that expected at the horizontal state should be applied to the second lower electrode 120*b*, which causes an increase in driving voltage.

Meanwhile, a switch is required to perfectly isolate signal transmission when it is in the "OFF" state. The seesaw-type MEMS switch for RF according to the embodiment of the present invention is very well suited to perform such isolation. More specifically, in the case of the "OFF" state, as the distance between the driving electrodes is relatively far, the signal transmission can be more perfectly isolated. In conventional bridge-type or cantilever-type structures, the initial state means the maximum isolation. However, in a seesaw-type switch, one side of the seesaw can rise up higher than in the initial state, by movement of the other side, whereby the maximum distance between the electrodes is increased. Therefore, it is possible to reduce the distance from the substrate to the upper electrodes calculated for a desired isolation value, as compared to conventional bridge-type or cantilever-type switches. Consequently, the distance between the electrodes is reduced, thereby making it possible to reduce the driving voltage. Since a driving force to produce a seesaw movement is inversely proportional to the square of the distance between the electrodes, by reducing the distance between the electrodes, it is possible to reduce the driving force. In addition, when a sufficiently low driving voltage is obtained, it is possible to provide an isolation value superior to the conventional manner.

Further, in a structure performing rotation movement, such as the cantilever-type or bridge-type, if the contact part is located at the end tip, the contact between the contact part and the transmission line on both sides of the gap may be point or linear contact type, with a small contact area, which causes a reduction in handling power. In order to solve this problem, the MEMS switch for RF according to the embodiment of the present invention is provided with the contact parts 142*a*, 142*b* formed of a metallic material to have a T-shape and spring parts 143*a*, 143*b* formed by removing a portion of the contact parts 142*a*, 142*b* at the region where the support 150 is bound to the contact part 142*a* or 142*b*. That is, the remaining metallic part of the contact parts 142*a*, 142*b* of the intermittent part 200 acts as a spring, which is deformed by the contact force between the contact parts 142*a*, 142*b* and the transmission line 110, to accomplish surface-to-surface contact between one of the contact parts 142*a*, 142*b* and the transmission line 110 on both sides of the corresponding one of the gaps 112*a*, 112*b*. The resilience of each of the spring parts 143*a*, 143*b* may be properly set by adjusting a width or a length of the spring part. In addition, a length of the intermittent part 200 may be adjusted to provide a sufficient force, i.e., the contact force, by which the contact parts 142*a*, 142*b* contact the first and second transmission lines 110*a*, 110*b*, respectively. If the length of the intermittent part 200 is sufficiently long, it is possible to obtain a sufficiently high contact force with a relatively low driving voltage.

Figure 7:
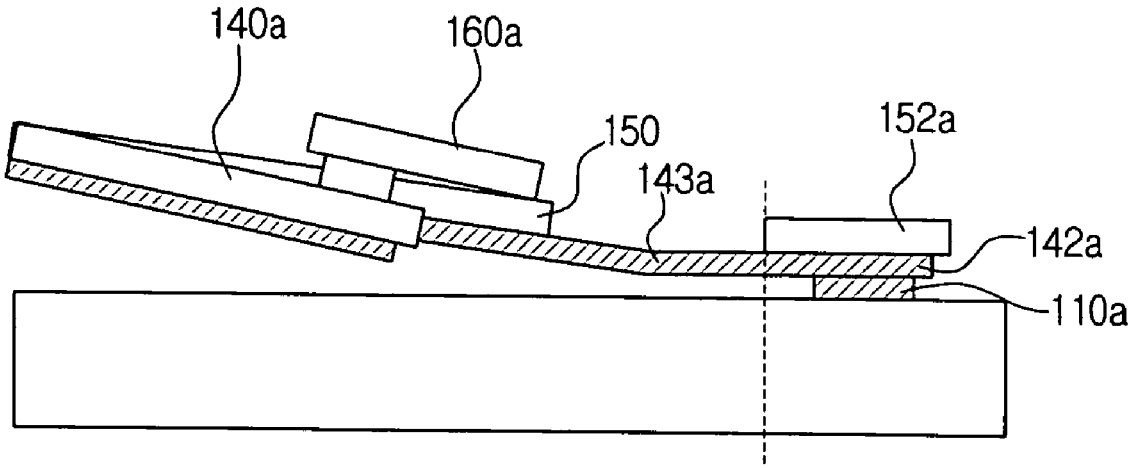
FIG. 7 illustrates a sectional view showing a spring part that is bent to provide surface contact between a contact part and a transmission line in the seesaw-type MEMS switch for RF shown in FIG. 2.

FIG. 7 illustrates an enlarged sectional view of the contact between the first contact part 142*a* and the first transmission line 110*a*. The cross bar 160*a* pushes down one end of the support 150 and the spring part 143*a* between the support 150 and the contact part 142*a* is bent due to the pressing force of the cross bar 160*a*.

Meanwhile, though the transmission line diverges into two lines from a signal input terminal in the MEMS switch for RF shown in the above-described embodiment, the switch of the present invention is not limited to a transmission line diverging into two but may be applied to a switch having a single transmission line. More specifically, using a seesaw having one contact point at one side, a single transmission line can perform the intermittent operation. In addition, though one pair of upper electrodes with a support disposed therebetween is provided in the above-described embodiment, the present invention is not necessarily limited to one pair but may have a single upper electrode driving one side corresponding to the lower electrode. Further, the cross bar may have an L-shape.

As described above, the seesaw-type MEMS switch for RF and a production method thereof according to an embodiment of the present invention is able to maintain a low driving voltage by separating the driving part from the contact part contacting a transmission line on both sides of a gap in the transmission line. A driving force and a restitution force are determined by areas of electrodes, a distance between electrodes, and a driving voltage. In a conventional electrostatic driving type switch, since areas of electrodes and the distance between electrodes corresponded with an area of a contact part and a distance between contacts, an increase in driving voltage is unavoidable. However, in the present invention, it is possible to maintain a low driving voltage by separating the structure of the electrodes from the contact part.

Moreover, by using the seesaw-type MEMS switch for RF according to the embodiment of the present invention, it is possible to prevent deformations, such as creep, since the moving structure has a transformation state of N-T-N-C-N.

Further, using the seesaw-type MEMS switch for RF according to the present invention, it is possible to more effectively eliminate stiction at the contact part by removal of the driving signal, load of the opposite part of the support about the pivot axis and the contact part, and the driving force of the other side with the aid of the spring part formed at the contact part for surface-to-surface contact.

Preferred embodiments of the present invention have been disclosed herein and, although specific terms are employed, they are used and are to be interpreted in a generic and descriptive sense only and not for purpose of limitation. Accordingly, it will be understood by those of ordinary skill in the art that various changes in form and details may be made without departing from the spirit and scope of the present invention as set forth in the following claims.

What is claimed is:

1. A seesaw-type MEMS switch, comprising:

a substrate;

a transmission line formed on the substrate having a gap therein to provide a circuit open condition;

an intermittent part formed a predetermined distance from the substrate, the intermittent part being operable to contact the transmission line on both sides of the gap by performing a seesaw movement about a seesaw movement axis; and a driving part to drive the seesaw movement of the intermittent part in response to a driving signal, wherein the intermittent part includes a contact part for providing surface-to-surface contact with the transmission line on both sides of the gap in response to the driving signal, and a spring part, integral with the contact part, for deforming in response to the driving signal.

2. A seesaw-type MEMS switch, comprising:

a substrate;

a transmission line formed on the substrate having a gap therein to provide a circuit open condition;

an intermittent part formed a predetermined distance from the substrate, the intermittent part being operable to contact the transmission line on both sides of the gap by performing a seesaw movement about a seesaw movement axis, wherein the intermittent part includes first spacers formed on a common electrode on the substrate, a first pivot part connected between the first spacers, and an intermittent bar cross-connected to the first pivot part for performing the seesaw movement; and a driving part to drive the seesaw movement of the intermittent part in response to a driving signal.

3. The seesaw-type MEMS switch as claimed in claim 2, wherein the intermittent bar comprises:

a contact part adapted to electrically contact the transmission line on both sides of the gap; and a support cross-connected with the first pivot part to support the contact part.

4. The seesaw-type MEMS switch as claimed in claim 3, wherein the support is formed of an insulating material and the contact part is formed at a bottom of the support to have a surface facing the gap.

5. The seesaw-type MEMS switch as claimed in claim 4, wherein the contact part is formed in a T-shape for providing surface-to-surface contact with the transmission line on both sides of the gap.

6. The seesaw-type MEMS switch as claimed in claim 5, wherein the contact part comprises a spring part formed by removing a portion of the contact part in contact with the support.

7. The seesaw-type MEMS switch as claimed in claim 6, wherein the transmission line comprises first and second transmission lines diverging from a signal input terminal, each having a gap at a position corresponding to an end of the intermittent bar.

8. The seesaw-type MEMS switch as claimed in claim 2, wherein the driving part comprises:

second spacers, each being formed to either side of the intermittent bar on the common electrode on the substrate;

lower electrodes, each formed at either side of the seesaw movement axis of the intermittent bar and on either side of the common electrode, respectively, over the substrate;

upper electrodes connected to the common electrode by the second spacers and second pivot parts, the upper electrodes being formed at either side of the intermittent bar to have a surface facing the lower electrodes; and a seesaw descent part connected to the upper electrodes to push down a side of the intermittent bar along with the seesaw movement of the upper electrodes descending in response to the driving signal selectively applied to one of the lower electrodes so that a contact part of the intermittent bar contacts the transmission line on both sides of the gap.

9. The seesaw-type MEMS switch as claimed in claim 8, in which the seesaw descent part comprises third spacers formed on the upper electrodes at either side of the intermittent bar and cross bars connecting adjacent third spacers at either side of the intermittent bar on the upper electrodes.

10. The seesaw-type MEMS switch as claimed in claim 9, wherein the cross bars are formed to have a block C-shape.

11. The seesaw-type MEMS switch as claimed in claim 2, wherein the intermittent part comprises:

a contact part for providing surface-to-surface contact with the transmission line on both sides of the gap in response to the driving signal; and a spring part, integral with the contact part, for deforming in response to the driving signal.

12. The seesaw-type MEMS switch as claimed in claim 11, wherein dimensions of the spring part are determined in accordance with a desired resilience.

13. The seesaw-type MEMS switch as claimed in claim 2, wherein a length of the intermittent bar is determined in accordance with a magnitude of the driving signal.

14. The seesaw-type MEMS switch as claimed in claim 1, further comprising:

a first electrode below the intermittent part; and a second electrode above the intermittent part, the first and second electrodes being separate from the intermittent part.

15. The seesaw-type MEMS switch as claimed in claim 14, further comprising a limiting element restricting movement of the second electrode away from the first electrode.

16. A method for manufacturing a MEMS switch comprising:

providing a first insulating layer on a substrate;

forming a transmission line, a common electrode, and lower electrodes on the first insulating layer, the transmission line having a gap therein for providing a circuit open condition and the lower electrodes being formed at either side of the common electrode to receive a driving signal;

forming first and second spacers on the common electrode;

forming an intermittent bar crossing a first pivot part connected between the first spacers, the intermittent bar being operable to electrically connect both sides of the gap formed in the transmission line, and forming upper electrodes at either side of the intermittent bar, the upper electrodes being connected to the second spacers by a second pivot part pivoting coaxially with the first pivot part and crossing the lower electrodes formed at either side of the common electrode; and forming a seesaw descent part to push down the intermittent bar due to the descending movement of one side of the upper electrodes descending in response to the driving signal selectively applied to one of the lower electrodes at either side of the common electrode so that one side of the intermittent bar contacts the transmission line on both sides of the gap.

17. The method as claimed in claim 16, wherein forming the transmission line comprises:

forming a first transmission line and a second transmission line diverging from a signal input terminal; and providing a gap in each of the first and second transmission lines at a position corresponding to an end of the intermittent bar.

18. The method as claimed in claim 16, wherein forming the first and second spacers comprises:

providing a sacrificial layer over the substrate having the transmission line, the common electrode, and the lower electrodes formed thereon;

forming via holes for first and second spacers to communicate with the common electrode through the sacrificial layer; and providing a metal layer on the sacrificial layer with the via holes formed therethrough.

19. The method as claimed in claim 16, wherein forming the intermittent bar comprises forming a contact portion that contacts the transmission line on both sides of the gap and a spring portion that deforms in response to the driving signal.

20. The method as claimed in claim 19, wherein forming the spring portion comprises determining dimensions of the spring portion to provide a desired resilience of the spring portion.

21. The method as claimed in claim 16, wherein forming the intermittent bar comprises determining a length of the intermittent bar in accordance with the driving signal.

22. The seesaw-type MEMS switch as claimed in claim 2, further comprising:

a first electrode below the intermittent part; and a second electrode above the intermittent part, the first and second electrodes being separate from the intermittent part.

23. The seesaw-type MEMS switch as claimed in claim 22, further comprising a limiting element restricting movement of the second electrode away from the first electrode.

24. A seesaw-type MEMS switch, comprising:

a substrate;

a transmission line formed on the substrate having a gap therein to provide a circuit open condition;

an intermittent part formed a predetermined distance from the substrate, the intermittent part being operable to contact the transmission line on both sides of the gap by performing a seesaw movement about a seesaw movement axis;

a first electrode below the intermittent part;

a second electrode above the intermittent part, the first and second electrodes being separate from the intermittent part; and a driving part to drive the seesaw movement of the intermittent part in response to a driving signal.

25. The seesaw-type MEMS switch as claimed in claim 24, further comprising a limiting element restricting movement of the second electrode away from the first electrode.

* * * * *